US009786139B2

(12) United States Patent
Lamb et al.

(10) Patent No.: US 9,786,139 B2
(45) **Date of Patent: *Oct. 10, 2017**

(54) PROGRAMMABLE SECURITY SENSOR

(71) Applicant: Ecolink Intelligent Technology, Inc., Carlsbad, CA (US)

(72) Inventors: Michael Lamb, Rancho Santa Fe, CA (US); Michael Bailey, Carlsbad, CA (US); Jay Stone, San Marcos, CA (US); George Seelman, Temecula, CA (US); Carlo Q. Petrucci, San Marcos, CA (US); Andrew Permenter, Carsbad, CA (US)

(73) Assignee: Ecolink Intelligent Technology, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/289,303

(22) Filed: Oct. 10, 2016

(65) Prior Publication Data

US 2017/0024984 A1 Jan. 26, 2017

Related U.S. Application Data

(63) Continuation of application No. 14/289,425, filed on May 28, 2014, now Pat. No. 9,489,828.

(51) Int. Cl.
*G08B 13/08* (2006.01)
*G08B 29/20* (2006.01)

(52) U.S. Cl.
CPC ..... *G08B 13/08* (2013.01); *G08B 29/20* (2013.01)

(58) Field of Classification Search
CPC ..... G08B 13/08; G08B 25/008
USPC ..... 340/547, 541, 545.1, 545.9, 551
See application file for complete search history.

(56) References Cited

U.S. PATENT DOCUMENTS

2015/0330140 A1* 11/2015 Kincaid ..... E06B 7/28 324/207.12
2016/0189496 A1* 6/2016 Modi ..... G08B 13/08 340/545.2

* cited by examiner

*Primary Examiner* — Toan N Pham
(74) *Attorney, Agent, or Firm* — Greenberg Traurig, LLP

(57) ABSTRACT

A programmable barrier alarm includes a sensor, such as a magnetic field detector, for sensing a magnetic field produced by the magnet and for producing an electronic signal associated with the magnetic field, a processor, and, a memory for storing an alarm threshold value and processor-executable instructions that, when executed by the processor, cause the sensor to, in a calibration mode of operation, calculate the alarm threshold value based on a first magnetic field sensed by the magnetic field detector when the barrier is in the closed position, and in a normal mode of operation, compare the electronic signal from the magnetic field detector to the alarm threshold value, and generate an alarm signal if the electronic signal falls below the alarm threshold value.

6 Claims, 7 Drawing Sheets

(Con't)

PROGRAMMABLE SECURITY SENSOR

RELATED APPLICATION INFORMATION

This application claims the benefit of and is a continuation of U.S. application Ser. No. 14/289,425, filed on May 28, 2014, now U.S. Pat. No. 9,489,828, the disclosure of which is incorporated herein by reference in its entirety.

BACKGROUND

I. Field of Use

The present application relates to the field of home security. More specifically, the present application relates to a particular type of door or window sensor for use in home security applications.

II. Description of the Related Art

Security systems for homes and offices have been around for many years. Often, these systems make use of barrier alarms, such as door and window sensors, in communication with a centrally-located alarm panel. Door and window sensors typically comprise two distinct parts: a magnet and a reed switch assembly. The magnet is typically installed onto a movable part of a window or onto a door edge, while the reed switch is mounted to a stationary surface, such as a wall adjacent to a door or window frame. When the door or window is closed, the magnet and reed switch are in close proximity to one another, and a relatively strong magnetic field is sensed by the reed switch, causing the switch to maintain a first state indicative of a "no alarm" condition. If the door or window is opened, proximity is lost between the magnet and the reed switch, resulting in a loss of the magnetic field in proximity to the reed switch, thus causing the reed switch to change state, e.g., from closed to open or from open to closed. The change of state is indicative of a local alarm condition (i.e., unauthorized opening of a door or window), and a signal may be generated by circuitry located within the reed switch assembly and sent, via wires or over-the-air, to the alarm panel. Alternatively, or in addition, a loud audible alert is generated, either at the alarm panel in the home or directly by the circuitry within the reed switch assembly, indicating that a door or window has been opened without authorization.

One of the disadvantages of typical door and window sensors is that they are only able to operate in a "binary" fashion: the reed switch is either open or closed. Thus, prior art sensors are not capable of determining how far a door or window has been opened.

Another disadvantage of prior art door and window sensors is that they may be defeated by placing an external magnet in proximity to the reed switch, thus allowing a door or window to be opened without causing an alarm.

Yet another disadvantage of prior art door and window sensors is that they must typically be mounted so that they are in very close proximity to the magnet when a door or window is closed. This is sometimes problematic when wide door or window frames, casements, casings, or jambs are encountered. The relatively wide displacement between the sensor and magnet in these situations does not allow the reed switch to change state when a door or window is closed.

Thus, it would be desirable to overcome the shortcomings of the prior art to provide door and window sensors that can be used on wide door/window frames, jambs, casements, or casings.

SUMMARY

The embodiments described herein relate to methods and apparatus of a programmable barrier alarm. In one embodiment, the programmable barrier alarm comprises a magnet and a sensor, the sensor comprising a magnetic field detector for sensing a magnetic field produced by the magnet and for producing an electronic signal associated with the magnetic field, a processor, and, a memory for storing an alarm threshold value and processor-executable instructions that, when executed by the processor, cause the sensor to, in a calibration mode of operation, calculate the alarm threshold value based on a first magnetic field sensed by the magnetic field detector when the barrier is in the closed position, and in a normal mode of operation, compare the electronic signal from the magnetic field detector to the alarm threshold value, and generate an alarm signal if the electronic signal falls below the alarm threshold value.

In another embodiment, a method is described for calibrating a programmable barrier alarm that is monitoring a barrier, the barrier alarm comprising a magnet and a sensor, the sensor comprising a memory, a processor, and a magnetic field detector, the method comprising entering into a calibration mode of operation, and while in the calibration mode of operation: detecting a magnetic field from the magnet by the magnetic field detector when the barrier is in a closed position, producing an electronic signal associated with the magnetic field by the magnetic field detector when the barrier is in the closed position, producing a first magnetic field value based on the electronic signal, and calculating an alarm threshold value based on at least the first magnetic field value. A normal mode of operation is then entered and, while in the normal mode of operation: comparing the electronic signal from the magnetic field detector to the alarm threshold value stored in memory, and generating an alarm signal if the electronic signal falls below the alarm threshold value.

BRIEF DESCRIPTION OF THE DRAWINGS

The features, advantages, and objects of the present invention will become more apparent from the detailed description as set forth below, when taken in conjunction with the drawings in which like referenced characters identify correspondingly throughout, and wherein.

DETAILED DESCRIPTION

The present description relates to a programmable security sensor used to protect a door or a window against unauthorized entry. Such security sensors may be referred to herein as "barrier alarms". In one embodiment, the programmable security sensor comprises a means for detecting a magnetic field and, based on the magnetic field, determining whether a monitored door or window ("barrier") is open or closed. An alarm signal may be generated and transmitted to an alarm panel located nearby, indicative of the door or window status (e.g., "open", "closed", "partially open", "open more than X inches", a transition between any of these states, etc.). The sensor is programmable, meaning that one or more thresholds may be actively set by a user during a calibration process. The thresholds determine whether a door or a window is open, closed, partially open, or transitioning between these states. The programmable nature of this sensor allows it to be mounted at varying distances from a corresponding magnet used in conjunction with the sensor. For example, the same sensor can be used in an application where a door jamb is six inches wide, as well as in an application where a door jamb is one inch wide.

Figure 1:
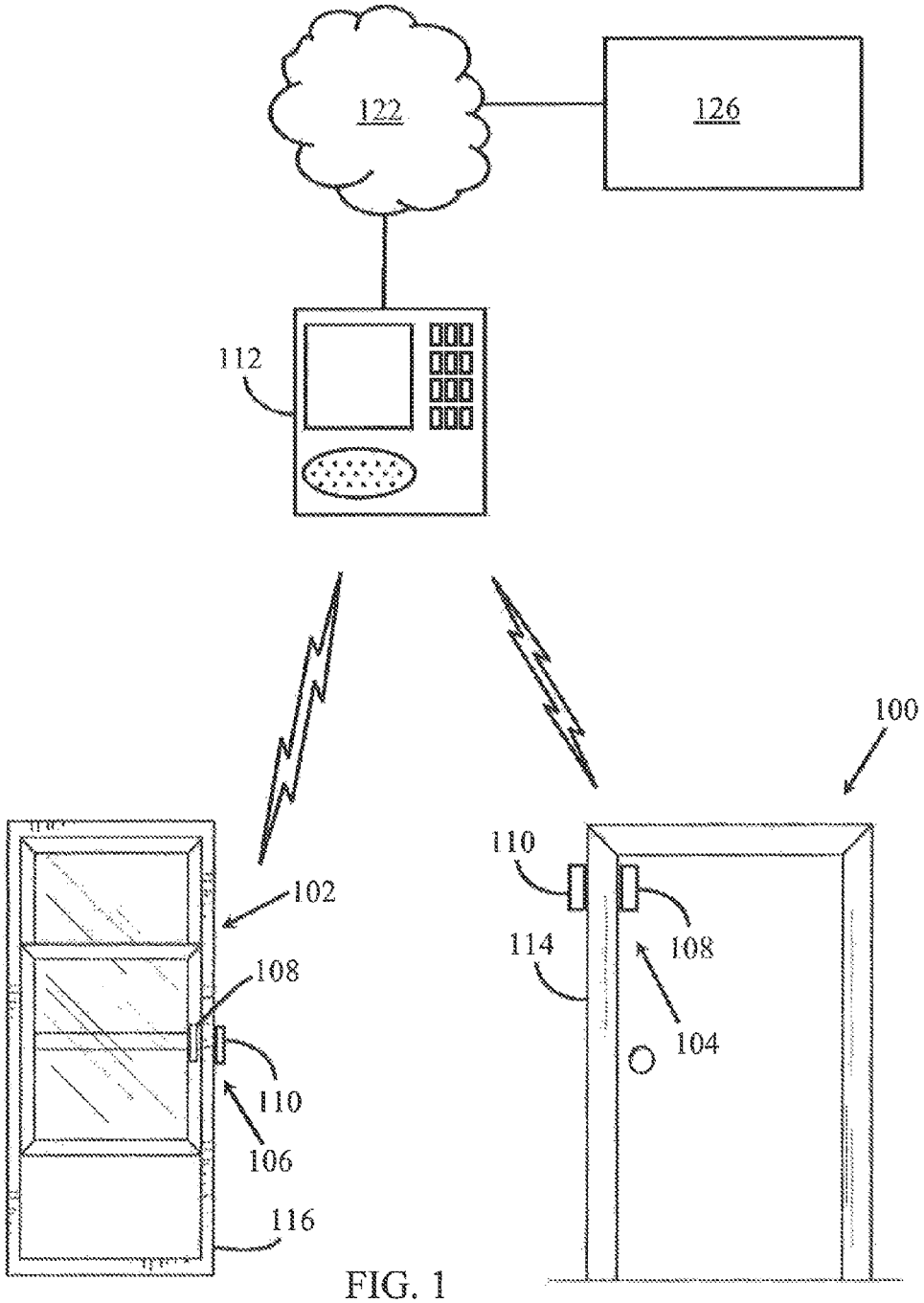
FIG. 1 is an illustration of a security system in accordance with one embodiment of the principles discussed herein.

FIG. 1 is an illustration of a security system in accordance with one embodiment of the principles discussed herein. In this embodiment a door 100 and a window 102 are monitored by programmable barrier alarms 104 and 106, respectively. Each of the programmable barrier alarms comprises a magnet 108 and a sensor 110. Magnet 108 is shown in FIG. 1 as mounted on a movable portion of door 100 and window 102, while sensor 110 is mounted on a wall on the other side of door jamb 114 and casing 116, in proximity to magnet 108 when door 100 or window 102 is in a closed position. However, in other embodiments, magnet 108 may be mounted to the wall and sensor 110 mounted to the movable door or window portion. Sensor 110 detects a magnetic field produced by the magnet and uses this detection as a basis for determining whether the door 100 or window 102 is open, closed, partially open, or transitioning between any of these states.

Each of barrier alarms 104 and 106 are programmable. That is, they are capable of having one or more thresholds set by a user after installation. This feature allows the same type of sensor and magnet to be used in a variety of installations where the distance between the magnet and the sensor may vary from one installation to the next by several inches, due to variations in door jamb and window casing widths. The one or more programmable thresholds are used to determine when a door or window is closed, open, partially open, opened greater than a predetermined distance, and/or transitioning between these states. Such programmability is discussed in greater detail later herein.

Each of the programmable barrier alarms communicate with alarm panel 112, typically using wireless RF signals generated by the programmable barrier alarms and/or alarm panel 112. For example, if door 100 is opened, sensor 110 detects a reduction or elimination of a magnetic field produced by magnet 108 as magnet 108 moves away from sensor 110 as door 100 is opened. In response, barrier alarm 104/106 generates and transmits an alarm signal to alarm panel 112 indicative of a local alarm condition, e.g., door 100 has been opened.

In some embodiments, alarm panel 112 may send messages to either of the programmable barrier alarms requesting a status of either one, e.g., whether a barrier being monitored is "open", "closed", partially open, a battery status, a tamper status, etc. In response, one or both programmable barrier alarms may transmit a response to alarm panel 112 indicating such a status, as the case may be. Other commands may be transmitted by alarm panel 112, such as "sound alarm", "turn on warning light", open gate, lock door, unlock window, etc.

As described above, alarm panel 112 performs monitoring of barrier alarms 104, 106, and other security devices (for example, tilt sensors, shock sensors, motion detectors, passive infra-red detectors, light interruption detectors, etc.) that may be part of the security system. In addition, alarm panel 112 generally provides an audible and/or visual of the status of the various sensors in the system (e.g., "open", "closed", "partially open", "open more than X distance", "on", "off", "normal", "alarm", etc.).

Alarm panel 112 may also be in communication with an off-site remote monitoring station 124 via communication network 122, such as the Internet, PSTN, a fiber optic communication network, a wireless communication network (e.g., cellular, data, satellite, etc.), and/or other wide-area network. Remote monitoring station 124 typically provides security monitoring services for homes and businesses equipped with security systems such as the one shown in FIG. 1. Remote monitoring station 124 is adapted to receive communications from alarm panel 112 via network 122 in response to alarm panel 112 receiving an indication of a local alarm condition being sensed by one or more barrier alarms/sensors in the security system. In other embodiments, alarm panel 112 simply receives raw data from the barrier alarms and determines, based on the data, whether a local alarm condition has occurred. When a local alarm condition is detected, alarm panel 112 generates a system alarm which may comprise taking one or more actions, such as notifying remote monitoring station 124 that a local alarm condition has occurred, illuminating one or more lights, sounding one or more audible alerts, etc.

Alarm panel 112 may be operated via voice commands, a keypad, or a touchscreen which allows users to enter and receive information to/from alarm panel 112. Users may, alternatively or in addition, provide information to, and receive information from, alarm panel 112 via a wireless communication device, such as a smartphone, tablet computing device, or other mobile computing device, and/or a fixed remote device, such as a desktop computer or remote keypad/touchscreen device in communication with alarm panel 112 either directly, or through a gateway device in communication with alarm panel 112 and network 122.

Figure 2:
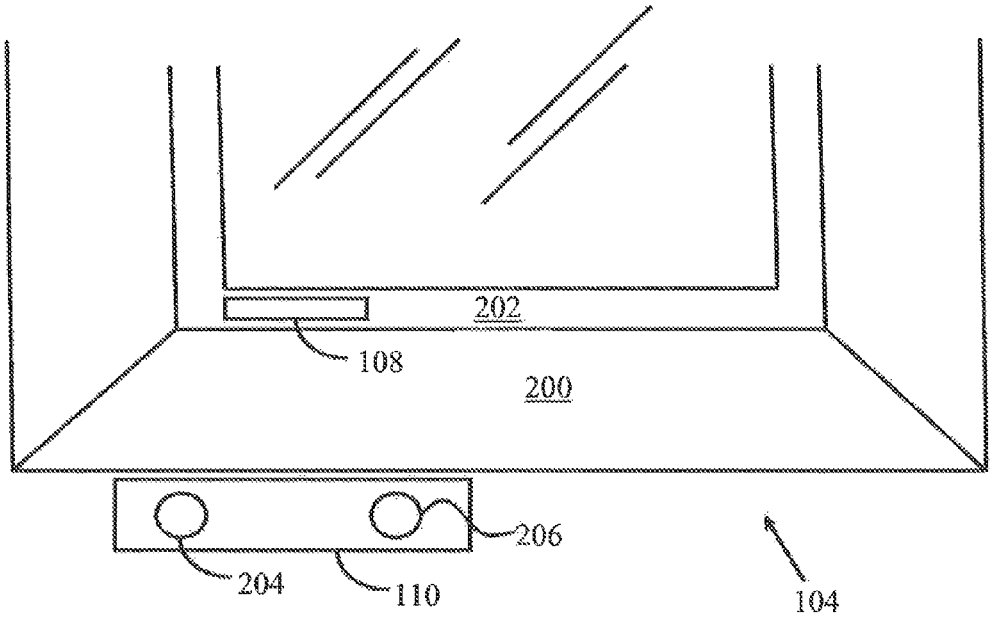
FIG. 2 is a close-up view of a programmable barrier alarm installed in an application having a wide window casing.
Figure 3:
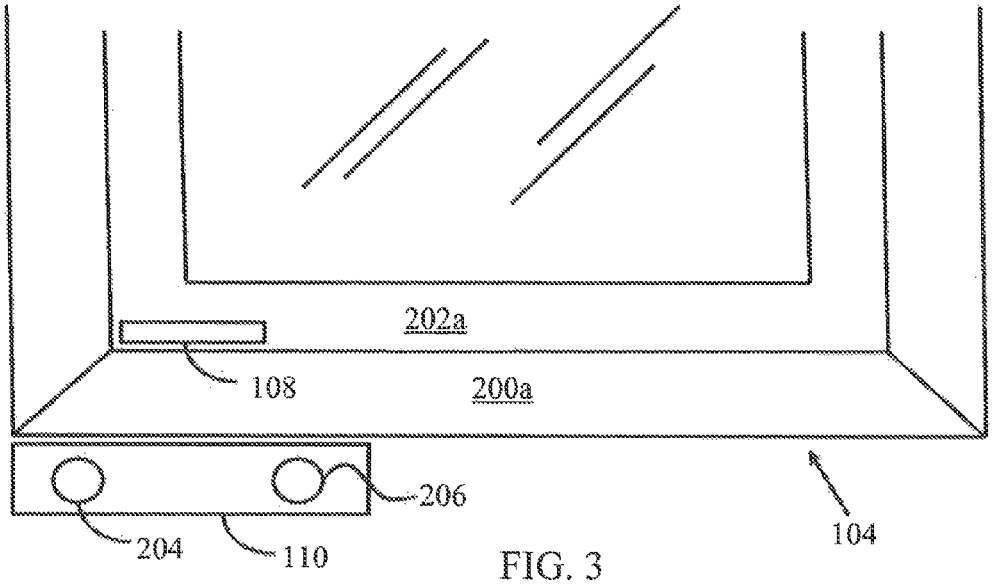
FIG. 3 is a close-up view of a programmable barrier alarm installed in an application having a narrow window casing.

FIG. 2 is a close-up view of one embodiment of a programmable barrier alarm 104 for monitoring a status of window 102. Only the lower portion of window 102 is shown. Here, the window 102 comprises a four inch wide window casing 200, such that sensor 110 is mounted to the wall on one side of the window casing 200, while magnet 108 is located on a movable portion of the window 202, as shown. In this installation, when the movable portion 202 is closed, the magnetic field in the vicinity of sensor 110 is less than the magnetic field would be if sensor 110 was mounted closer to the magnet, such as the case shown in FIG. 3. In this figure, the same sensor 110 and magnet 108 are mounted on another window **102*a*, this window 102*a* having a window molding 200*a* that is more narrow than the one shown in FIG. 2, for example, one inch wide. The magnetic field in the vicinity of sensor 110 in this case is stronger than the magnetic field in the vicinity of sensor 110 shown in FIG. 2, because magnet 108 and sensor 110 in FIG. 3 are closer together than magnet 108 and sensor 110 in FIG. 2. Other physical properties could also affect the magnetic field in the vicinity of sensor 110, including the type (i.e., material) and density of casing 200/200*a*, the depth of casing 200/200*a*, or an external object such as a metal bookshelf or metal art piece placed in the vicinity of sensor 110**.

Programmable barrier alarm 104 (or 106) may comprise a user input device 204 for providing a signal to a processor within sensor 110 to enter a calibration mode, for example, entering a state where one or more thresholds may be set, the thresholds for determining the status of the window (e.g., open, closed, partially opened, open more than a predetermined distance, etc.). Such a user input device 204 may comprise a mechanical switch (i.e., pushbutton, momentary pushbutton, toggle, slide, etc.), an opto-electrical switch, a heat sensing device (to detect the presence of a human finger), a capacitive sensor, a microphone, or any other type of switch or sensor to provide an indication to sensor 110 that a user wishes to place the programmable barrier alarm into a calibration mode, and/or to provide signals to the processor within sensor 110 indicating that the window (or door) is in a certain position during the calibration process, for example, closed, open, partially open, opened a predetermined distance (for example, 6 inches, allowing air to enter the window or door, but not enough for a person to pass). In other embodiments, user input device 204 is not present, and the signal to place to sensor 110 into the calibration mode is provided using another method, such as detecting when the door or window has been slammed shut, slammed open, or a combination of these and/or other movements. Detection of such events may be accomplished by sensor 110 comprising an accelerometer or other similar device, and providing a signal to a processor within sensor 110.

Sensor 110 may further comprise status indicator 206, used to convey the status of programmable barrier alarm as being armed or disarmed, the term "armed" referring to an ability to detect and/or report an event (e.g., movement of a door or window, closing/opening of a door or window, door or window being in a certain state, such as open or closed, etc.), and the term "disarmed" referring to a condition where the barrier alarm cannot detect and/or report an event. Further, status indicator 206 may provide an indication to a user that sensor 110 has accepted input from the user, such as after the user has entered the calibration mode by blinking repeatedly. Still further, status indicator 206 may provide an indication to a user that sensor 110 is ready for the user to take some action, such as progressing to a next step in a calibration procedure. Status indicator 206 may comprise an LED, LCD, or any other device for providing a visual status of the barrier alarm, or it may comprise a device capable of emitting audible tones, messages, alerts, etc., that also indicate a status of the programmable barrier alarm. In one embodiment, indicator 206 comprises a multi-color LED, for example an LED package that is able to produce red light and a green light, red for indicating that the barrier alarm is disabled and green for indicating that the barrier alarm is armed. Of course, other colors may be used to differentiate between an armed and unarmed condition. In other embodiments, two or more visual indicators may be used to convey status.

Figure 4:
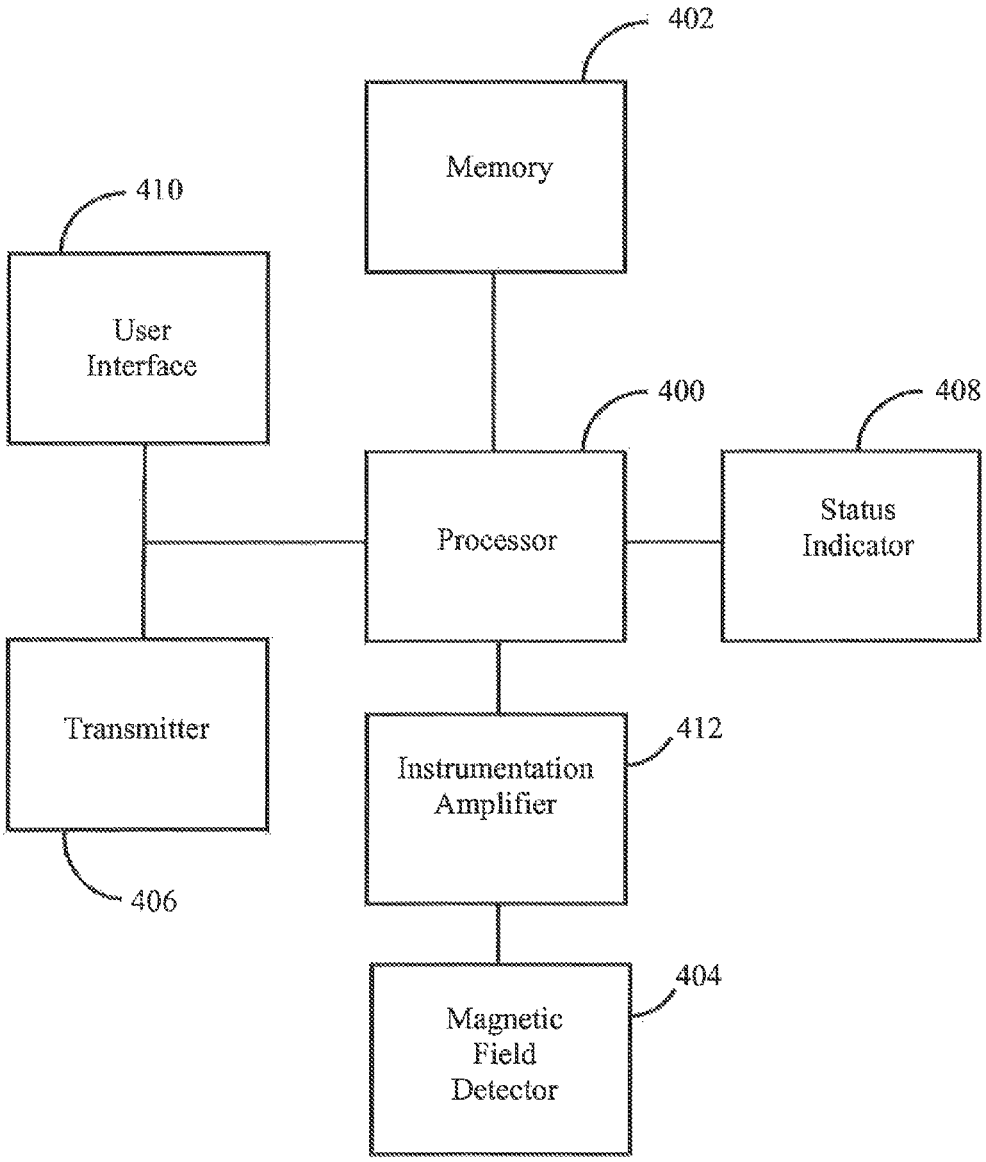
FIG. 4 is a functional block diagram of one embodiment of the barrier alarm shown in FIG. 1, 2 or 3.

FIG. 4 is a functional block diagram of one embodiment of sensor 110 as part of barrier alarm 104 or 106. Specifically, FIG. 4 shows processor 400, memory 402, magnetic field detector 404, transmitter 406, status indicator 408, user interface 410, and optional instrumentation amplifier 412. It should be understood that not all of the functional blocks shown in FIG. 4 are required for operation of the barrier alarm (for example, status indicator 408 may not be present), that the functional blocks may be connected to one another in a variety of ways, and that not all functional blocks are necessary for operation of the barrier alarm are shown (such as a power supply), for purposes of clarity.

Processor 400 is configured to provide general operation of programmable barrier alarm 104 or 106 by executing processor-executable instructions stored in memory 402, for example, executable code. Processor 400 typically comprises a general purpose microprocessor or microcontroller able to fit within the housing of sensor 110, while consuming very little power, enabling sensor 110 to operate for many months or years before battery replacement becomes necessary. Such a processor 400 may comprise an ADuC7024 microcontroller manufactured by Analog Devices, Inc. of Norwood Mass., although any one of a variety of microprocessors, microcomputers, and/or microcontrollers may be used alternatively.

Memory 402 comprises one or more non-transitory information storage devices, such as RAM, ROM, EEPROM, UVPROM, flash memory, SD memory, XD memory, or other type of electronic, optical, or mechanical memory device. Memory 402 is used to store processor-executable instructions for operation of programmable barrier alarm 104 or 106, as well as any information used by processor 400, such as threshold information, parameter information, identification information (e.g., sensor serial number), current or previous door or window status information, audible or visual alerts for driving status indicator 408, etc. Memory 402 excludes media for propagating signals.

Magnetic field detector 404 is coupled to processor 400 and senses one or more attributes of a magnetic field produced by magnet 108. For example, magnetic field detector 404 may detect the strength, direction, and/or polarity of the magnetic field produced by magnet 108, in one or more axis, and produce a voltage proportional to these properties. An example of such a magnetic field detector 404 is the ZMY20 magnetic field sensor manufactured by Diodes Incorporated of Dallas, Tex. In one embodiment, magnetic field detector 404 comprises a magnetoresistive sensor, which changes its resistive value in proportion to a strength, direction, and/or polarity of a magnetic field. When a voltage is applied to such a sensor, it produces a varying voltage proportional to the strength, direction, and/or polarity of a sensed magnetic field. This voltage may be applied to an analog-to-digital converter, either onboard the sensor itself, or externally, to provide a digital value to processor 400 for storage in memory 402. In other embodiments, the signal is provided directly to an A/D port on processor 400.

In one embodiment, the output of magnetic field detector 404 is provided to instrumentation amplifier 412, for amplification to a desired voltage level or range, as the output voltage and/or voltage range from magnetic field detector 404 may be on the order of only a few millivolts. In one embodiment, instrumentation amplifier 412 amplifies the signal from magnetic field detector 404 by a fixed amount. In another embodiment, the gain of instrumentation amplifier 412 may be controlled by processor 400. This may be particularly useful if the size, strength, or other characteristics of magnet 108 is unknown, the proximity between sensor 110 and magnet 108 varies from one installation to the next, and/or a door jamb or window casing material varies from one installation to another. Each of these conditions may result in a different voltage output from magnetic field detector 404 from one installation to another. Gain control by processor 400 is described later herein with reference to the method of FIG. 6.

Instrumentation amplifier 412 is typically an analog integrated circuit, although it could also be formed from discreet components, such as one or more transistors, resistors, capacitors, etc. Its gain may be controlled by one or more analog or digital signals provided by 400, or the gain may be fixed, typically by configuring one or more resistors in accordance with a manufacturer's datasheet.

In other embodiments, magnetic field detector 404 comprises any device that reacts to a magnetic field strength, direction, and/or polarity, such as a Hall Effect sensor, a magneto-diode, a magneto-transistor, a magneto-optical sensor, a Lorentz force based MEMS sensor, a MEMS compass, or any other magnetic sensor that detects changes in a magnetic field, excluding reed switches. In an embodiment where magnetic field detector 404 comprises a magnetoresistive sensor, its resistance changes as the magnetic field in the vicinity of sensor 110 changes as the door or window to which magnet 108 is mounted is opened and closed. For example, the resistance of magnetic field detector 404 may increase as the magnetic field strength increases as magnet 108 is moved closer to sensor 110 as a window is being closed. As a result, a voltage or current may change in proportion to the resistive change of magnetic field detector 404, allowing processor 400 to determine a door or window position based on the voltage or current from magnetic field detector 404. In other embodiments, a signal from magnetic field detector 404 is converted into a digital signal that is then provided to processor 400.

Transmitter 406 comprises circuitry necessary to wirelessly transmit alarm signals and other information from the barrier alarm to alarm panel 112, either directly or through in intermediate device, such as a repeater, commonly used in popular wireless mesh networks such as Z-wave or Zigbee networks. Such circuitry is well known in the art and may comprise BlueTooth, Wi-Fi, RF, optical, ultrasonic circuitry, among others. Alternatively, or in addition, transmitter 406 comprises well-known circuitry to provide signals to alarm panel 112 via wiring, such as telephone wiring, twisted pair, two-conductor pair, CAT wiring, AC home wiring, or other type of wiring.

Status indicator 408 is used to convey the status of the barrier alarm (e.g., "armed", "disarmed", etc.) and/or to provide alerts to a user during, for example, a calibration process, such as "open window/door fully", "close window/door fully", "open window/door to a desired point", etc. Status indicator 408 may comprise one or more LEDs, LCDs, or any other device for providing a visual status of the barrier alarm, or it may comprise a device capable of emitting audible tones, messages, alerts, etc., that also indicate a status of the barrier alarm. In one embodiment, indicator 408 comprises a multi-color LED, for example an LED package that is able to produce red light and a green light, red for indicating that the barrier alarm is disabled and green for indicating that the barrier alarm is armed. Of course, other colors may be used to differentiate between an armed and unarmed condition. In other embodiments, two or more visual indicators may be used to convey status.

User interface 410 is used to provide user input to processor 400. For example, user interface 410 may allow a user to signal processor 400 that the user is ready to being a calibration process, to "arm" or "disarm" the programmable barrier alarm, to alert processor 400 to when a step in a calibration process has been completed (e.g., window/door has been opened/closed fully), etc. User interface 410 may comprise, simply, of a mechanical switch (e.g., pushbutton, momentary pushbutton, toggle, slide, etc.), opto-electrical switches, heat sensing devices (to detect the presence of a human finger), capacitive sensors, or any other type of switch or sensor to provide user input to processor 400.

In normal operation, processor 400 executes processor-executable instructions stored in memory 402 that causes the barrier alarm to monitor information provided by magnetic field detector 404 for changes in one or more states, physical conditions, attributes, status, or parameters of something being monitored, such as the condition of a door or window being "open" or "closed" via a change in a magnetic field sensed by magnetic field detector 404. Processor 400 uses data from the magnetic field detector 404 to determine whether a predetermined condition has occurred relating to the barrier alarm (herein "local alarm condition"), such as a door or window being monitored by a barrier alarm changing state from "closed" to "open", "open" to "closed", or "closed" to "open more than a predetermined distance", in the case where the barrier alarm allows a door or window to be opened a certain distance, for example 4 inches, to allow air to enter but not an intruder without creating a local alarm condition. If processor 400 determines that one or more predetermined conditions have been satisfied, indicating the occurrence of a local alarm condition, it generates an alarm signal and provides the alarm signal to transmitter 406 for transmission to alarm panel 112. In one embodiment, the alarm signal comprises a notification to alarm panel 112 that a local alarm condition has been detected by sensor 404.

The processor-executable instructions stored in memory 402 also comprise instructions for processor 400 to enter into a calibration mode, where various thresholds may be set by a user. This calibration mode is described in further detail below.

Figure 5:
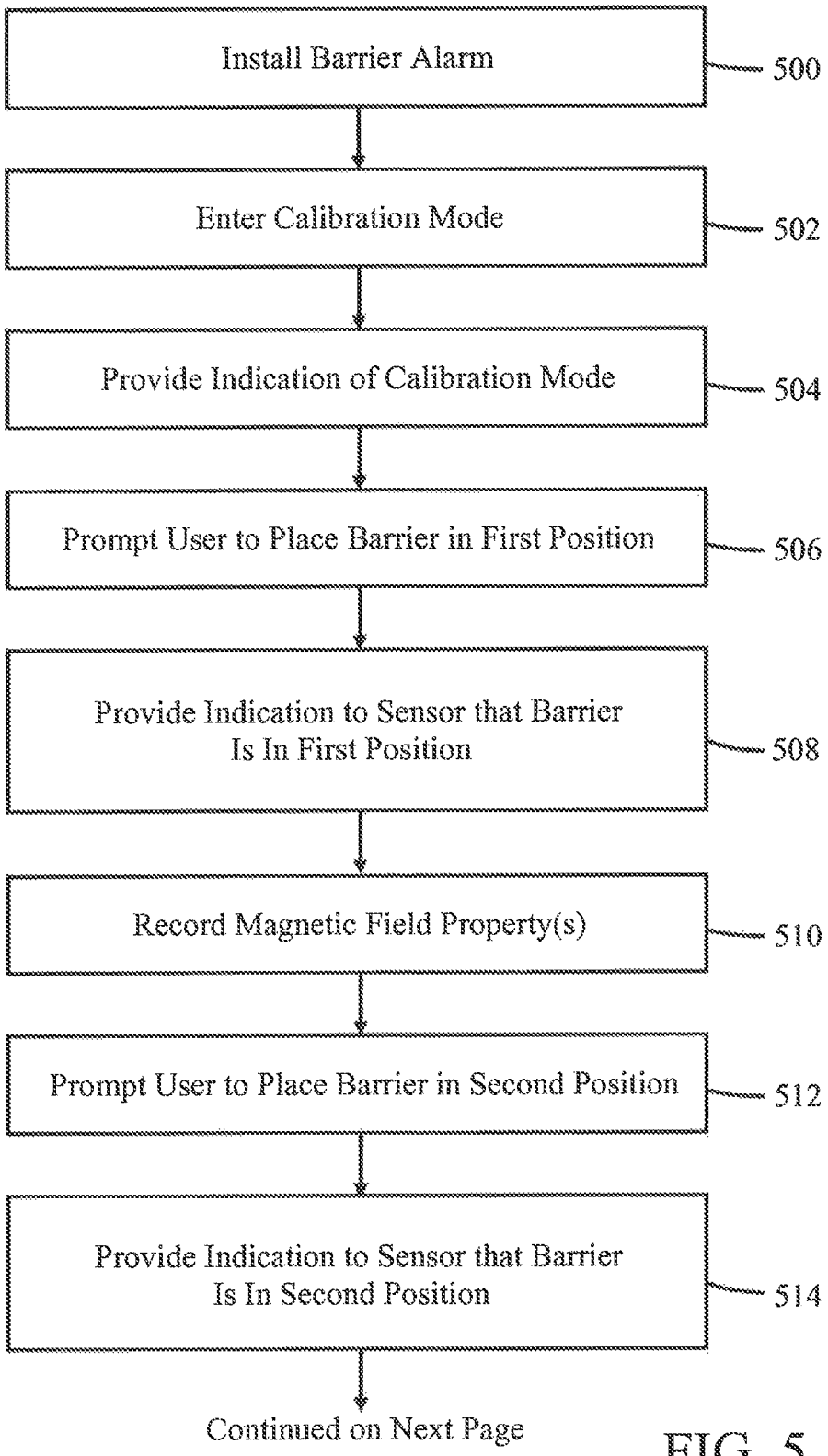
FIG. 5 is a flow diagram illustrating one embodiment of a method for calibrating the programmable barrier alarm of FIGS. shown in FIG. 1, 2 3, or 4.
Figure 5:
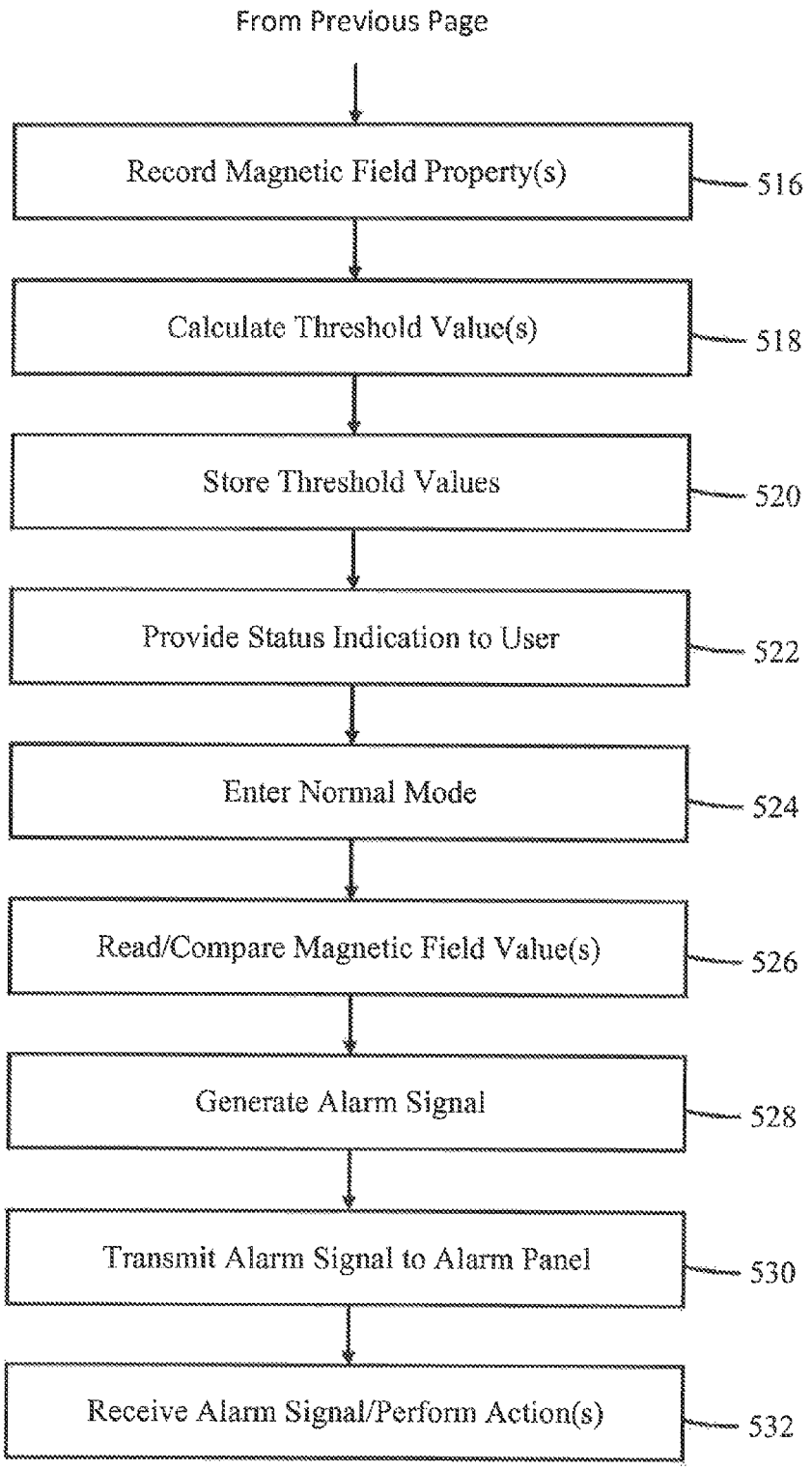

FIG. 5 is a flow diagram illustrating one embodiment of a method of calibrating programmable barrier alarm 104/106 as performed by processor 400. It should be understood that in some embodiments, not all of the steps shown in FIG. 5 are performed. It should also be understood that the order in which the steps are carried out may be different in other embodiments.

At block 500, a sensor 110 of a programmable barrier alarm 104/106 is physically installed onto a movable portion of a door or window, or installed on a wall adjacent to a door jamb or window casing of a door or window to be monitored. Magnet 108 is installed onto either the door or window movable portion, or to the wall adjacent to the door jamb or window casing, depending on where the sensor 110 is located.

At block 502, a user of the programmable barrier alarm places the programmable barrier alarm into a calibration mode by providing in a signal to processor 400 via user input 410. For example, a user might press a button located on sensor 110 for a predetermined time period, such as three seconds. In another embodiment, the calibration mode may be entered automatically after a battery is first installed and/or sensor 110 turned on for the first time.

At block 504, processor 400 may provide a signal to status indicator 408, causing status indicator 408 to provide an audio and/or visual indication to the user that sensor 110 has successfully entered the calibration mode.

At block 506, the user may be prompted to position the movable portion of a door or window into a first position, such as a closed position or an open position, by status indicator 408. For example, status indicator 408 could emit a red light as a prompt for the user to open the door or window to a certain position, such as a maximum open position, or a position where magnet 108 will be located far enough from sensor 110 that the magnetic field in the vicinity of sensor 100 is minimal.

After the user has placed the door or window into the first position, the user may provide an indication to processor 400 via user interface 410 that the door or window has been placed into the first position, at block 508. For purposes of discussion, it will be assumed that a window has been placed into an open position. The user may provide such indication to processor 400 using user interface 410, i.e., by pressing a button, which generates a signal that is received by processor 400. In another embodiment, processor 400 automatically determines that the door or window has been placed into the first position by determining that the magnetic field sensed by magnetic field detector 404 has remained stable for a predetermined time period, such as five seconds.

At block 510, processor 400 records one or more properties of the magnetic field produced by magnet 108, as determined by magnetic field detector 404, and stores at least one of the properties in memory 402 as a first magnetic field value, typically a digital value proportional to a voltage produced by magnetic field detector 404. The magnetic field properties may include properties produced by other magnetic sources as well in proximity to sensor 110. In the present example, the magnetic field detector 404 may detect a weak or non-existent magnetic field strength, due to the fact that magnet 108 is positioned a relatively far distance (e.g., greater than 8 inches) from sensor 110. However, magnetic field detector 404 may detect the presence of some other, ambient magnetic field from another magnetic source that is located nearby sensor 110. Thus, magnetic field detector 404 provides an indication of one or more magnetic field properties to processor 400 related to the magnetic field produced by magnet 108, plus one or more magnetic field properties related to a magnetic field produced by a magnetic source other than magnet 108.

Figure 6:
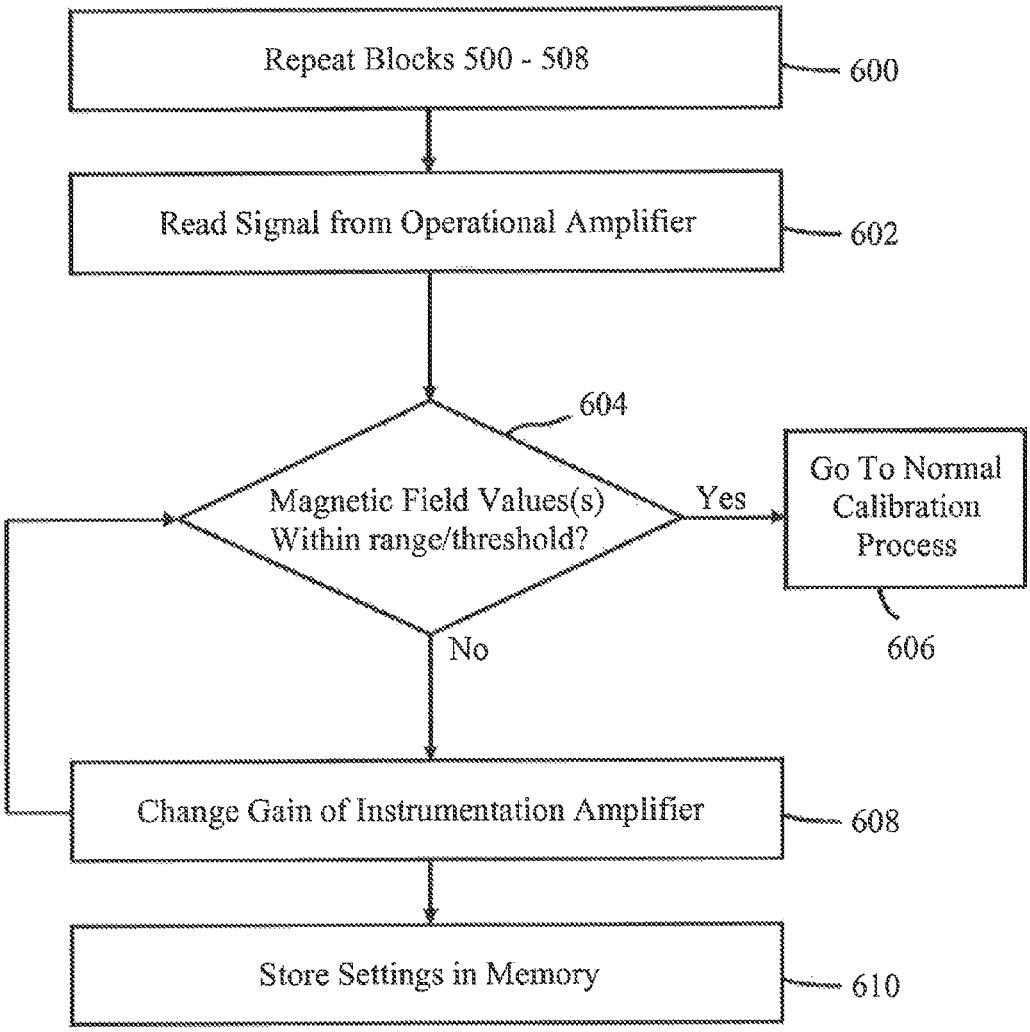
FIG. 6 is a flow diagram illustrating another embodiment of a method of calibrating the programmable barrier alarm of FIGS. shown in FIG. 1, 2 3, or 4.

In another embodiment, described by the method of FIG. 6, the signal from the magnetic field detector 404 is provided to instrumentation amplifier 412 for amplification and/or signal processing.

At block 512, after processor 400 has recorded one or more magnetic field properties in memory 402, the user may be prompted to position the movable portion of the door or window into a second position, such as a closed position, by status indicator 408. For example, status indicator 408 could emit a green light as a prompt for the user to close the door or window so that the magnetic field in the vicinity of sensor 110 is maximized.

After the user has placed the door or window into the second position, the user may provide an indication to processor 400 via user interface 410 that the door or window has been placed into the second position, at block 514. In the present example, the window has been placed into a closed position. The user may provide such indication to processor 400 using user interface 410, i.e., by pressing a button, which generates a signal that is received by processor 400. In another embodiment, processor 400 automatically determines that the door or window has been placed into the second position by determining that the magnetic field sensed by magnetic field detector 404 has remained "steady" for a predetermined time period, such as five seconds.

At block 516, processor 400 records one or more properties of the magnetic field produced by magnet 108, as determined by magnetic field detector 404, and stores the one or more properties in memory 402, typically a digital value proportional to a voltage produced by magnetic field detector 404. The magnetic field properties may include properties produced by other magnetic sources. In the present example, the magnetic field detector 404 may detect a relatively strong magnetic field strength, due to the fact that magnet 108 is positioned fairly close to sensor 110 (e.g., the width of a door jamb or window casing).

At block 518, processor 400 determines one or more alarm threshold values, in one embodiment, based on the first and second magnetic field values stored in memory 402, for use in determining whether a local alarm condition exists, e.g., whether the door or window has opened more than a predetermined amount. In another embodiment, an alarm threshold value threshold may be based on the second magnetic field value alone (i.e., a magnetic field value sensed when the door or window is closed). For example, the alarm threshold value may be set at a value of some percentage, such as 90%, of the second magnetic field value. In another example, the alarm threshold value may be set to a smaller percentage of the second magnetic field value, such as 20%, to enable the door or window to open a small distance before generating an alarm signal.

In one embodiment, processor 400 subtracts the first magnetic field value from the second magnetic field value to obtain a difference, then multiplies the difference by a predetermined threshold percentage value, such as 75% to obtain an alarm threshold value. For example, if the first magnetic field value recorded by processor 400 in memory 402 is a digital value equal to 30 millivolts (door/window placed in an open position) from magnetic field detector 404 or instrumentation amplifier 412, and the second magnetic field value recorded by processor 400 is a digital value equal to 2.1 volts from the magnetic field detector or instrumentation amplifier 412, the difference between these two values is 2.07 volts. If a 75% threshold percentage value is used, then the alarm threshold value is 75% of 2.07 volts, or 1.553 volts. The threshold percentage value is then used to determine whether the door or window has opened more than a threshold amount, by comparing the voltage generated by magnetic field detector 404 or instrumentation amplifier 412 to the alarm threshold value of 1.553 volts.

In other embodiments, the threshold percentage value is different than 75%. A greater threshold percentage value will result in processor 400 generating an alarm signal when a door or window is opened less than when the threshold percentage value is less than 75%. Thus, the sensitivity of detection can be set by using a different threshold percentage values. The threshold percentage value may be pre-stored in memory 402 during manufacture of sensor 110 or it may be programmed by a user using user interface 410.

At block 520, processor 400 stores the one or more alarm threshold values in memory 402.

At block 522, status indicator 408 may provide an indication to the user that the alarm threshold value has been calculated and/or that sensor 110 is ready for use.

At block 524, sensor 110 enters a normal operation mode, where it monitors one or more magnetic field properties to determine if a door or window has opened. This may occur automatically after block 518, 520, and/or 522, or it may be entered by the user manually entering normal mode via user interface 410.

At block 526, processor 400 periodically determines one or more magnetic field properties sensed by magnetic field detector 404 and compares it (them) to at least the alarm threshold value stored in memory 402. For example, if the magnetic field strength is greater than the alarm threshold value, no additional action is taken by processor 400.

If, however, a comparison of one or more readings from magnetic field detector 404 against the stored alarm threshold value indicates that the magnetic field strength has decreased below the alarm threshold value, then processor 400 generates an alarm signal, comprising a signal to alert one or more entities that a local alarm event has occurred, e.g., a door or window has opened, shown in block 528.

At block 530, the alarm signal causes one or more actions to occur, including sounding an audible alert at sensor 110 via status indicator 408, illuminating one or more lights at sensor 110 via status indicator 408, and/or transmitting the alarm signal to alarm panel 112.

At block 532, alarm panel 112 receives the alarm signal and, in response, causes one or more actions to occur, including sounding an audible alert at alarm panel 112, illuminating one or more lights at alarm panel 112, providing an indication as to which sensor 110 is providing the alarm signal, and/or transmitting an indication of the alarm signal to remote monitoring facility.

FIG. 6 is a flow diagram illustrating another embodiment of a method of calibrating programmable barrier alarm 104/106 as performed by processor 400. It should be understood that in some embodiments, not all of the steps shown in FIG. 6 are performed. It should also be understood that the order in which the steps are carried out may be different in other embodiments.

At block 600, blocks 500-508 shown in FIG. 5 and described above, are repeated.

At block 602, after a door or window has been placed in a closed position, processor 400 reads a signal from instrumentation amplifier 412.

At block 604, if the signal from instrumentation amplifier 412 is within a predetermined range, processing continues to block 606, where the normal calibration process of FIG. 5 continues at block 510. The predetermined range is stored in memory 402 during the manufacturing stage, typically coinciding with an acceptable input voltage range of processor 400. For example, many processors today operate with an input voltage of between 0 and 3.3 volts. Thus, the predetermined range, in those cases, may be selected as between 0 and 3.3 volts. In another embodiment, a desired voltage level is stored in memory 402, indicative of a desired voltage level from instrumentation amplifier 412 when magnet 108 is in close proximity to sensor 110, e.g., when the door or window is in a closed position. For example, the desired voltage level may be 1.65 volts. This voltage level may have an acceptable voltage range associated with it, such as +/−200 millivolts, or a lower threshold of 1.45 volts and an upper threshold of 1.85 volts, in each case stored in memory 402.

If the voltage from instrumentation amplifier 412 is not within the predetermined range and/or level stored in memory 402, processing continues to block 608, where processor 400 provides a signal to instrumentation amplifier 412, or otherwise causes instrumentation amplifier 412 to increase the gain if the signal from instrumentation amplifier 412 is less than the predetermined threshold/range/level or decrease the gain if the signal from instrumentation amplifier 412 is greater than the predetermined threshold/range/level. Processor typically continues to monitor the signal from instrumentation amplifier 412 until the predetermined threshold/range/level is reached, at which point processor 400 maintains the gain of instrumentation amplifier 412. Thus, sensor 110 is able to set the first magnetic field value to a level that can be easily processed by processor 400, no matter what kind of magnet is used in association with sensor 110, the distance between sensor 100 and the magnet when the door or window is closed, or the type of material of a door jamb or window casing that may be in-between sensor 110 and the magnet which may prevent repeatable voltage outputs at instrumentation amplifier 412 from one installation to another.

At block 610, an indication of the gain setting of instrumentation amplifier 412 is stored in memory 402, e.g., an indication of the signal necessary from processor 400 to achieve the gain determined at block 608, an actual gain of instrumentation amplifier 412, and/or the measured voltage at block 608 (this voltage may be used as the first magnetic field value, described above).

Figure 7:
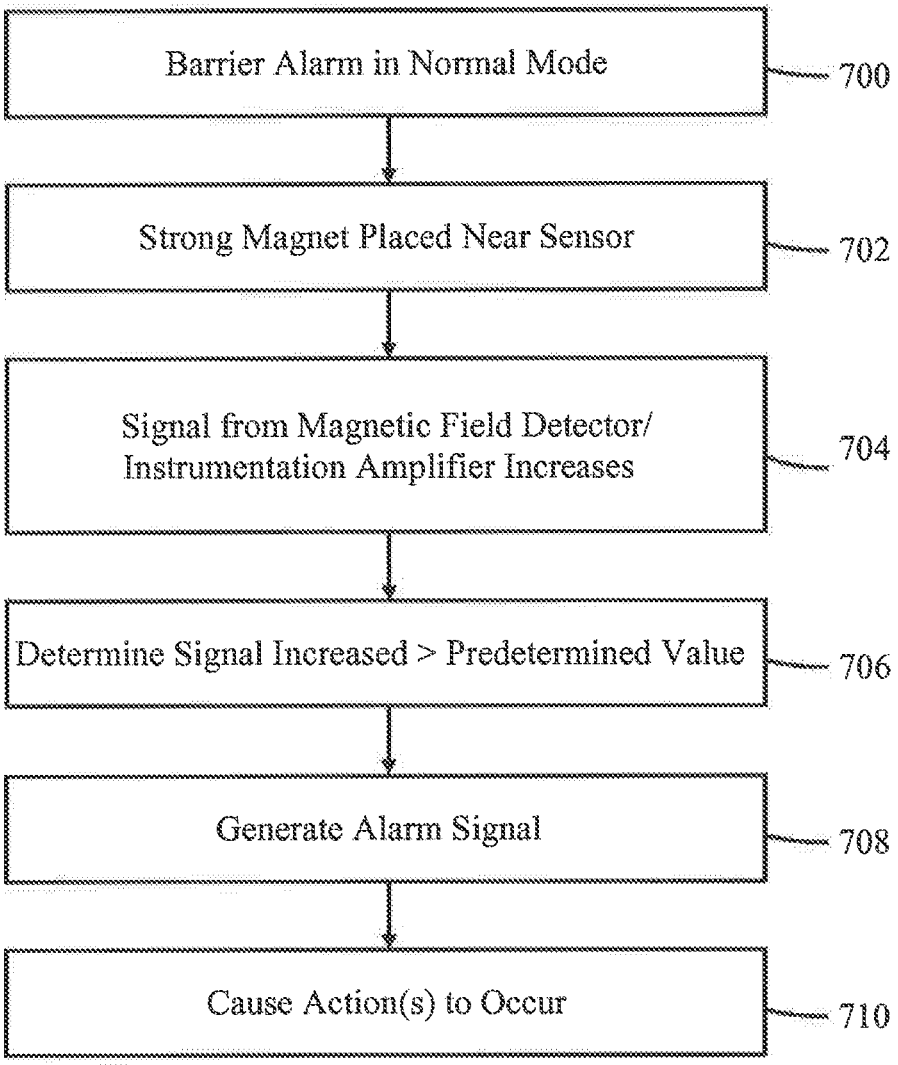
FIG. 7 is a flow diagram illustrating one embodiment of a method of detecting a false magnetic reading by the programmable barrier alarm of FIGS. shown in FIG. 1, 2 3, or 4.

FIG. 7 is a flow diagram illustrating a method of detecting a false magnetic reading by sensor 110 as performed by processor 400. It should be understood that in some embodiments, not all of the steps shown in FIG. 7 are performed. It should also be understood that the order in which the steps are carried out may be different in other embodiments.

At block 700, it is assumed that barrier alarm 104/106 is in a normal mode of operation, e.g., has been calibrated using one or both methods described by FIG. 6 or 7, that the door or window is in a closed position, and that barrier alarm 104/106 is "armed", e.g., will produce an alarm signal if the door or window is opened, or opened more than a predetermined distance, as described above.

At block 702, an intruder may attempt to defeat barrier alarm 104/106 and gain entry through the door or window being monitored by barrier alarm 104/106 by placing a strong magnet in proximity to sensor 110, outside of the structure. The magnetic field from the strong magnet would cause a prior art reed switch to maintain a closed or open position as the magnet located on a door or window was moved away from sensor 110 by virtue of the door or window being opened by the intruder. Thus, the intruder may be able to open the door or window without setting off the barrier alarm in prior art barrier alarm devices.

At block 704, as the intruder's strong magnet is placed in proximity to sensor 110, the magnetic field in the vicinity of sensor 110 increases dramatically. As a result, the voltage produced by magnetic field detector 404 and/or instrumentation amplifier 412 also increases dramatically.

At block 706, processor compares the voltage from magnetic field detector 404 (or from instrumentation amplifier 412, if used) to the second magnetic field value stored in memory (i.e., an attribute of the magnetic field, such as field strength, during calibration while the door or window is closed), as described above in the method of either FIG. 5 or FIG. 6. If the signal from magnetic field detector 404 (or from instrumentation amplifier 412) is greater than a predetermined value, for example the second magnetic field value, processing continues to block 612, where processor 400 generates an alarm signal, indicating that a strong magnetic field has been sensed by sensor 110, greater than the magnetic field recorded when the door or window was in the closed position during calibration. This could mean that an intruder is trying to defeat barrier alarm 104/106 by placing a strong magnet in proximity to sensor 110. In other embodiments, the predetermined value could be higher than the second magnetic field value, to allow for small variations in the magnetic field sensed by magnetic field detector 404 when the door or window is closed over time. The predetermined value may be stored in memory 402 after processor 400 determines the second magnetic field value, either by storing the second magnetic field value as the predetermined value or by storing a value based on the second magnetic field value, such as "the second magnetic field value plus 0.5 volts" or "the second magnetic field value times a percentage, such as 1.2 percent".

At block 708, in response to detecting that the signal from the magnetic field detector 404 (or from instrumentation amplifier 412) is greater than the predetermined value, processor 400 generates an alarm signal, indicative of a local alarm event. In one embodiment, this alarm signal specifically denotes the alarm condition as one being where the magnetic field in the vicinity of sensor 110 has increased past an allowable value, such as the magnetic field associated with the second magnetic field value. In another embodiment, the alarm signal generated at block 708 does not differentiate between the magnetic field increasing past the allowable point verses a loss or reduction in the magnetic field strength in the vicinity of sensor 110 as a result of a door or window being opened.

At block 710, the alarm signal causes one or more actions to occur, including sounding an audible alert at sensor 110 via status indicator 408, illuminating one or more lights at sensor 110 via status indicator 408, and/or transmitting the alarm signal to alarm panel 112.

The methods or algorithms described in connection with the embodiments disclosed herein may be embodied directly in hardware or embodied in processor-readable instructions executed by a processor. The processor-readable instructions may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components.

Accordingly, an embodiment of the invention may comprise a computer-readable media embodying code or processor-readable instructions to implement the teachings, methods, processes, algorithms, steps and/or functions disclosed herein.

While the foregoing disclosure shows illustrative embodiments of the invention, it should be noted that various changes and modifications could be made herein without departing from the scope of the invention as defined by the appended claims. The functions, steps and/or actions of the method claims in accordance with the embodiments of the invention described herein need not be performed in any particular order. Furthermore, although elements of the invention may be described or claimed in the singular, the plural is contemplated unless limitation to the singular is explicitly stated.

What is claimed is:

1. A non-transient, computer readable media having instructions stored thereon for configuring a programmable barrier alarm used to monitor a condition of a barrier, the instructions, when executed by a processing device of the programmable barrier alarm, causing the programmable barrier alarm to perform steps comprising:

sensing a first magnetic field generated by a magnet associated with the barrier while the barrier is in a first position;

sensing a second magnetic field generated by the magnet associated with the barrier while the barrier is in a second position that is different than the first position; and using the sensed first magnetic field and the sensed second magnetic field to configure the programmable barrier with an alarm threshold whereupon the configured programmable barrier will function to generate an alarm signal in response to the configured programmable barrier sensing that a magnetic field generated by the magnet associated with the barrier falls below the alarm threshold while the configured programmable barrier is in a barrier condition monitoring mode of operation.

2. The non-transient, computer readable media as recited in claim 1, wherein the first position corresponds to a closed position of the barrier and the second position corresponds to an open position of the barrier.

3. The non-transient, computer readable media as recited in claim 1, wherein the instructions cause the first magnetic field to be sensed in response to a user interface element of the programmable barrier being activated.

4. The non-transient, computer readable media as recited in claim 1, wherein the instructions cause the second magnetic field to be sensed in response to a user interface element of the programmable barrier being activated.

5. The non-transient, computer readable media as recited in claim 1, wherein the sensed second magnetic field generated by the magnet associated with the barrier comprises a value measured over a predetermined period of time.

6. The non-transient, computer readable media as recited in claim 1, wherein the threshold value comprises a percentage difference between the sensed first magnetic field and the sensed second magnetic field.

* * * * *